United States Patent [19]

Sweeney

[11] Patent Number: 4,544,040

[45] Date of Patent: Oct. 1, 1985

[54] APPARATUS FOR DRIVING AN ELONGATED PIECE INTO AND/OR OUT OF THE GROUND

[75] Inventor: Gerald T. Sweeney, Puyallup, Wash.

[73] Assignee: Tigre Tierra, Inc., Puyallup, Wash.

[21] Appl. No.: 626,471

[22] Filed: Jun. 29, 1984

Related U.S. Application Data

[63] Continuation of Ser. No. 520,219, Aug. 5, 1983, abandoned, which is a continuation of Ser. No. 266,948, May 26, 1981, abandoned.

[51] Int. Cl.[4] ..... B25D 9/18

[52] U.S. Cl. ..... 173/91; 173/29; 173/78; 173/147; 137/625.48; 251/326

[58] Field of Search ..... 173/13, 15, 29, 47, 173/78, 91, 125, 128, 132, 134, 147; 91/305, 306, 307; 137/625.48; 251/326

[56] References Cited

U.S. PATENT DOCUMENTS

| | | | |
|---|---|---|---|
| Re. 28,151 | 9/1974 | Cook | 173/91 |
| 284,282 | 9/1883 | Cram | 173/125 X |
| 2,068,045 | 1/1937 | Wohlmeyer | 173/125 X |
| 3,045,611 | 7/1962 | Murray | 91/306 X |
| 3,172,485 | 3/1965 | Spannhake et al. | 173/147 |
| 3,692,123 | 9/1972 | Gyongyosi | 173/147 |
| 3,895,680 | 7/1975 | Cook | 173/78 |
| 4,172,411 | 10/1979 | Matsuda et al. | 91/307 X |

FOREIGN PATENT DOCUMENTS

| | | | |
|---|---|---|---|
| 322248 | 12/1929 | United Kingdom | 173/125 |
| 1430159 | 3/1976 | United Kingdom | 173/127 |
| 639994 | 1/1979 | U.S.S.R. | 173/127 |

OTHER PUBLICATIONS

McKuren Terry Corporation, drug dated 7-11-66, and entitled "No. 6 Well Casing Setter (Self Stopping)".

Diamond Drill Contracting Co., Catalog p. J-1, entitled "Pipe and Casing Driving Assembly", and p. 6, price sheet of Longyear Company, dated 11-1-57, referencing to such an assembly.

Title page, backside thereof, and pp. 176-179, of *Diamond Drill Handbook*, of 1956/62/64.

*Primary Examiner*—Robert P. Olszewski

*Attorney, Agent, or Firm*—Christopher Duffy

[57] ABSTRACT

An anvil is formed on one end of an elongated piece and the piece is driven into the ground or the like by impacting the anvil with a reciprocable ram driven by a drive mechanism that is operated by a valve which is reciprocably mounted in a normally balanced two directional fluid pressure circuit to reciprocate in the alternate directions thereof when the circuit is unbalanced in the respective directions thereof. The circuit has a pair of outlets therein which are connected with the opposing ends of the valve and disposed to slidably engage with the ram during the stroke thereof. The ram comprises an anvil impacting body having a striking surface on one end thereof and a pair of grooves in one laterally oriented face thereof which are mutually offset longitudinally the the reciprocable axis of the body on spaced parallel lines to form collateral mutually longitudinally offset lands on the lines. The grooves are adapted in axial extent, respectively, to discharge fluid from one of the outlets while the corresponding land covers the other outlet, and vice versa, to generate opposing fluid pressure differentials in the circuit across the valve and thereby unbalance the circuit in the respective directions thereof, when the body is reciprocably supported and guided in the apparatus and driven by the mechanism so that the lines of the grooves and lands intersect the outlets.

30 Claims, 9 Drawing Figures

APPARATUS FOR DRIVING AN ELONGATED PIECE INTO AND/OR OUT OF THE GROUND

RELATED APPLICATION

This application is a continuation of Application Ser. No. 520,219 filed Aug. 5, 1983 and entitled Apparatus For Driving an Elongated Piece Into and Out of the Ground, which in turn was a continuation of Application Ser. No. 266,948 filed May 26, 1981 under the same title. Both are now abandoned.

THE INVENTION IN GENERAL

This invention relates to apparatus for driving an elongated piece into and/or out of the ground or the like, and particularly to apparatus of this nature wherein means are connectible with the piece to form an anvil on one end thereof for the transmission of impact forces to the piece, and the piece is driven into or out of the ground or the like by impacting the anvil with a ram.

According to the invention, the apparatus comprises support means and an anvil-impacting ram which is moveably guided on the support means to reciprocate along an axis parallel to the longitudinal axis of the piece. The ram has a plurality of hollow chambers operatively symmetrically enclosed therewithin, and the support means have means thereon defining elongated guides in the respective chambers. The guides have septa thereon which are relatively fixed in the chambers transverse the reciprocable axis of the ram to form pistons which separate the relatively axially opposing sets of end portions of the chambers from one another. The apparatus also comprises drive means for reciprocating the ram through the stroke thereof. The drive means include means defining a source of pressurized gas and an outlet for exhausting used gas to atmosphere. They also include valve means which are operable to interconnect the pressurized gas source and the outlet with alternate but opposing sets of chamber portions, as well as means which are responsive to reciprocation of the ram to operate the valve means. The valve operating means include means which define a pair of elongated control surfaces extending parallel to the reciprocable axis of the ram on one laterally oriented face of the ram, and having first portions thereof spaced apart from one another along lines extending parallel to the reciprocable axis of the ram, to correspond to the end portions of the stroke of the ram. The surfaces are mutually offset from one another longitudinally of the axis so that they have second portions thereof which overlap one another longitudinally of the axis from line to line. The valve operating means also include sensor means which are disposed adjacent the one face of the ram on the support means to register with the control surfaces during the stroke of the ram. The sensory means are accompanied in turn by actuator means which are operable to cause the valve means to admit the pressurized gas to one set of chamber portions while discharging used gas to the outlet from the other set of chamber portions when the sensory means are in registry with the respective first portions of the control surfaces and the second portions thereof are moving relatively toward the sensor means, and additionally, to cause the valve means to reverse the gas flow to and from the respective sets of chamber portions when the sensory means are in registry with the respective first portions of the control surfaces and the second portions are moving relatively away from the sensory means.

Preferably, the control surfaces are also operative to prepare the valve means for reversal of the gas flow to and from the respective sets of chamber portions when the sensory means are in registry with the second portions of the control surfaces, so that the change in direction of flow is gradual.

In certain of the presently preferred embodiments of the invention, the valve means, the sensor means, and the actuator means are interconnected by the control surfaces in a normally-balanced two-directional circuit, and the control surfaces are operable to unbalance the circuit in one direction thereof when the sensor means are in registry with the first portions of the surfaces at the ends of the lines corresponding to said one direction and the second portions are moving away from the sensory means, then rebalance the circuit when the sensory means are in registry with the second portions of the surfaces, and then unbalance the circuit in the other direction thereof when the sensor means are in registry with the first portions of the surfaces at the ends of the lines corresponding to said other direction and the second portions are moving away from the sensory means. In other embodiments, the valve means include a reciprocable valve member and means for applying a pair of mutually opposing signals to the valve member to balance the same against reciprocation. The actuator means operate to generate a differential between the signals to unbalance the valve member in the sense of admitting the gas to one set of chamber portions while the used gas is discharged to the outlet from the other set of chamber portions, and vice versa.

In one group of embodiments, the aforementioned circuit is a fluid pressure circuit and the valve means include a valve member which is reciprocably mounted in the circuit to reciprocate in one direction thereof when the circuit is unbalanced in the aforesaid one direction thereof, and to reciprocate in the other direction thereof when the circuit is unbalanced in the aforesaid other direction thereof. In certain embodiments of the group, the sensory means take the form of a pair of fluid outlets in the pressurized fluid circuit which are connected with the opposing ends of the valve member and slidably engageable with the one face of the ram to register with the control surfaces thereon. The control surfaces themselves take the form of a pair of grooves in the one face of the ram which are mutually offset longitudinally the reciprocable axis of the ram on spaced parallel lines to form collateral mutually longitudinally offset lands on the lines. The grooves are adapted, respectively, to discharge fluid from one of the outlets while the corresponding land covers the other outlet, and vice versa. In this way, they generate opposing fluid pressure differentials in the circuit across the valve member during the to and fro motion of the ram in the end portions of its stroke. Meanwhile, the grooves overlap with one another along the lines thereof so that the respective fluid pressure differentials across the valve member undergo gradual change from one differential to the other.

Many of the presently preferred embodiments of the invention employ sets of chamber portions which have a common crosssectional area about the guides transverse the reciprocable axis of the ram. The valve means interconnect the pressurized gas source and the outlet with the respective sets of chamber portions to admit and discharge gas to and from the respective chamber portions in each set independently of one another and independently of the chamber portions in the other set.

For various reasons, the ram often has an axial bore therethrough. For example, in certain presently preferred embodiments of the invention, the apparatus further comprises means insertable in the axial bore of the ram to adapt the apparatus so that the ram can be employed to drive the piece out of the ground or the like. In some of these embodiments, the support means have an anvil forming drive head thereon and the bore insertable adaption means include means for forming an additional anvil on the support means, on the opposite side of the ram from the drive head. In certain of the latter, the drive head is tubular and the additional anvil forming means have a projection thereon insertable through the ram and the drive head for attachment to the piece.

Furthermore, the ram may have an axial bore therethrough and the anvil may be tubular, so that a drill string can be inserted into the piece through the bore of the ram. Also, the body of the anvil may be adapted to form a passage whereby liquid can flow therethrough during the drilling operation. Where the piece itself is tubular, moveover, the drill string can be inserted into one end of the piece, and can be operated in the piece while the piece is driven into the ground or the like by impacting the anvil with the ram. Normally, the chambers are operatively symmetrically enclosed within the ram about the bore thereof in all such embodiments.

The apparatus may also comprise means for positioning the support means in relation to the piece, and means for restraining the support means against reciprocation from the position thereof when the ram is retracted from the piece for delivery of the next blow to the same.

The guides often take the form of posts relatively upstanding on the support means. The ram is slidably guided on the posts so that the chambers are operatively enclosed therewithin about the posts, there being collars on the respective posts defining the septa.

The pressurized gas source and the outlet are often connected to the sets of chamber portions through the relatively remote ends of the posts.

The invention also concerns a particular ram for use in apparatus of the foregoing nature. The ram comprises an anvil impacting body having a striking surface on one end thereof and a pair of grooves in one laterally oriented face thereof which are mutually offset longitudinally the reciprocable axis of the body on spaced parallel lines to form collateral mutually longitudinally offset lands on the lines. The ram is particularly suited to being driven by a drive mechanism that is operated in the aforedescribed manner, that is, by a valve which is reciprocably mounted in a normally balanced two directional fluid pressure circuit to reciprocate in the alternate directions thereof, the circuit having a pair of fluid outlets therein which are connected with the opposing ends of the valve and disposed to slidably engage with the body of the ram during the stroke thereof. More particularly, the aforementioned grooves on the one face of the body of the ram are adapted in axial extent, respectively, to discharge fluid from one of the outlets, while the corresponding land covers the other outlet, and vice versa. In this way, the grooves generate opposing fluid pressure differentials in the circuit across the valve and thereby unbalance the circuit in the respective directions thereof when the body is reciprocably supported and guided and driven by the drive mechanism so that the lines of the grooves and lands intersect the outlets. Preferably, the grooves overlap one another along the lines thereof so that the respective fluid pressure differentials across the valve undergo gradual change from one differential to the other. In addition, the ram preferably has an axial bore through the body thereof so that it can be used to impact a tubular anvil while a drill string is inserted through the bores of the ram and the anvil into one end of an elongated tubular piece having the anvil connected therewith.

BRIEF DESCRIPTION OF THE DRAWINGS

These features will be better understood by reference to the accompanying drawings wherein the invention is employed as the hammer mechanism for the casing driver of a well drilling apparatus.

In the drawings.

DESCRIPTION OF THE PREFERRED EMBODIMENTS

Figure 1:
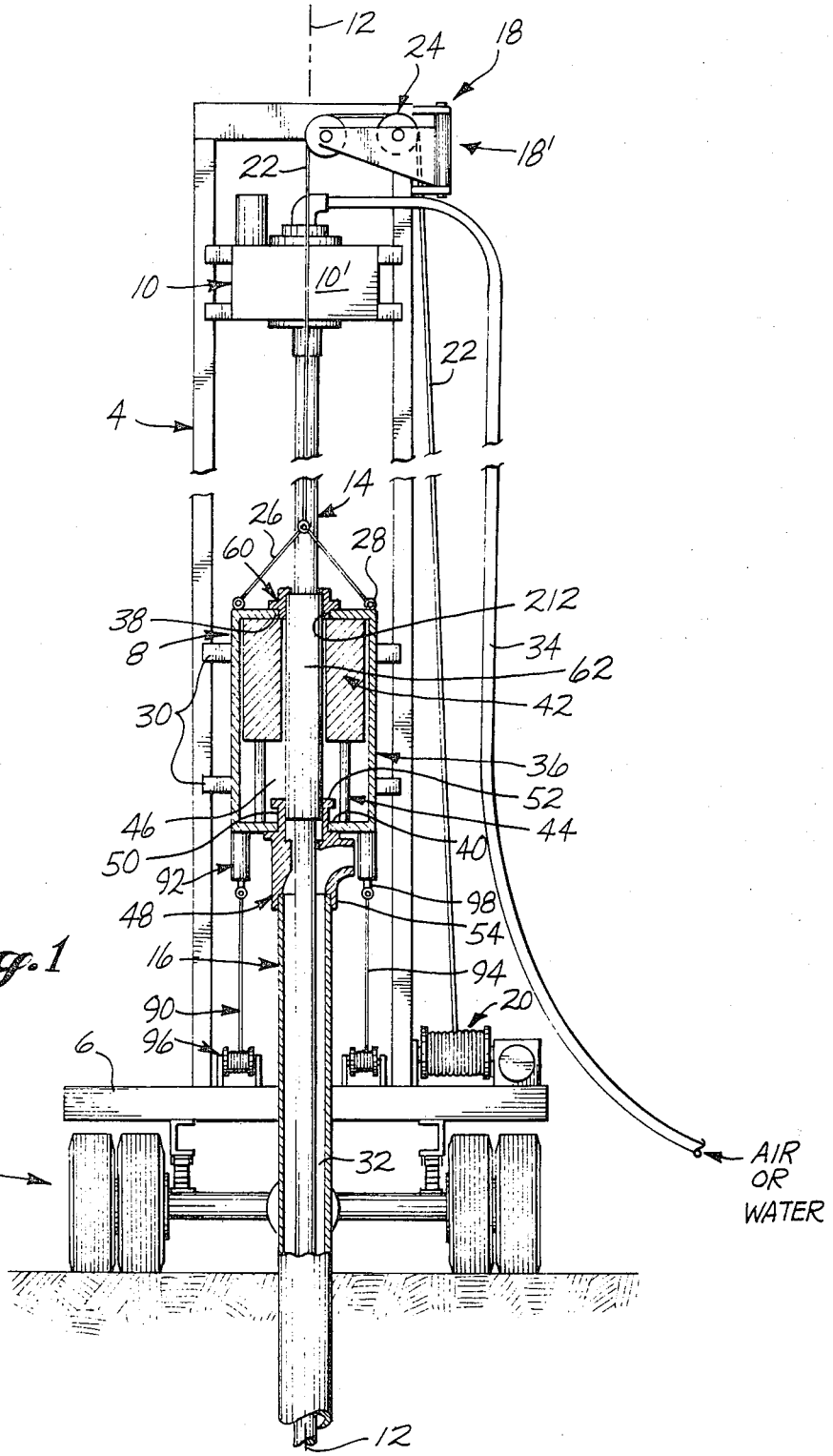
FIG. 1 is a rear elevational view of a truck mounted version of the well-drilling apparatus with certain components thereof being shown in part cross sectional and/or part schematic form.

Referring to the drawings and FIGS. 1–4 in particular, it will be seen that the well drilling apparatus is mounted on a truck 2 for portability and comprises a vertically elongated mast or tower 4 which is erected at the rear of the truck bed 6 to support a compressed-air-driven hammer mechanism 8 and a motor-driven rotary drill mechanism 10 on an operational axis 12 outboard thereof. The drill mechanism 10 is adapted to advance successive sections of a hollow drill string 14 into the ground along the axis, while successive sections of a tubular casing 16 are simultaneously concentrically driven into the ground by the hammer mechanism 8. Accordingly, each of the mechanisms is suspended between the rearmost standards 4' of the tower 4 by means of a hoisting device 18 which enables it to be raised and lowered relative to the ground below. However, in the interest of simplifying the illustration, only that device, 18', for suspending the hammer mechanism is shown. This comprises a power driven winch 20, the cable 22 of which is roved upward about a head block assembly 24 that is pivotally mounted at the top of the tower and equipped with a crotch line 26 which is eye bolted to the top of the hammer mechanism. The eye bolts 28 are disposed in a cross sectional plane of the mechanism outboard of the axis 12, to free the axis for the drill string; and the body of the mechanism is equipped with laterally projecting ears 30 which are slidably interengaged with the rearmost standards 4' of the tower to assure that the mechanism 8 remains in alignment with the axis as it is raised and lowered on the tower. Furthermore, according to conventional practice, air or water is made available at the head 10' of the drill mechanism 10 to enable the fluid to be charged into the remote end of the casing 16 through the bore of the drll string to flush the cuttings back through the annulus 32 formed between the casing and the drill string. The fluid is supplied to the head by a hose connection 34 to the same, whereas the cuttings are discharged at the top of the casing 16, as shall be explained shortly.

The hammer mechanism 8 comprises a hollow case 36 which has openings 38 and 40 in the top and bottom thereof, respectively, that are mutually eccentrically located inboard the plane of the crotch line 26 to register with the operational axis 12 of the mechanism. The hammer mechanism also comprises a tubular ram 42 which is slidably impaled on a pair of strut-like posts 44 that are upstanding in the hollow 46 of the case on opposite sides of the openings 38 and 40 to register with the axial cross sectional plane 12 of the mechanism. The ram is sized and dimensioned to balance the mechanism about the plane of the crotch line, and is driven in a manner to be explained, so as to impact against an anvil-forming drive head 48 in the bottom opening 40 of the case. The drive head 48 has a wide circumferential groove 50 about the body thereof, and is interengaged with the edge of the opening 40 at the groove so as to project both inside and outside of the case. The relatively inside portion forms an anvil 52 for the ram. The relatively outside portion 54 is adapted to be telescopically engaged with the top portion of the well casing. Meanwhile, the neck 56 (FIG. 2) of the groove enables the case and the head to undergo relative reciprocation during the driving operation, and the interengagement of the edge of the opening 40 with the groove 50 assures that the head 48 will be retained on the case when the head is detached from the well casing.

Like the ram, moreover, the drive head 48 is tubular so that the drill string 14 can gain access to the bore of the casing through the same. Also, the relatively outside portion 54 of the head has a nippled port 58 in one side thereof to enable the cuttings to be discharged from the same during the flushing operation. However, in the event that not all of the cuttings are discharged through the port, an annular boss 60 is bolted or otherwise secured about the opening 58 in the top of the case, and a sleeve-like tube 62 is threadedly suspended from the boss in slidable engagement with the bores 42' and 48' of the ram and the drive head, respectively, to provide a tubular liner through which any stray cuttings can discharge out the top of the head.

Preferably, the bore 48' of the drive head is counterbored from the top to provide a shoulder 64 in the same above the port 58, and a pair of wear rings 66 and 68 are inserted in the counterbore 48" to rest in stacked relationship on the shoulder 64. The bottom ring 66 forms a journal for the drill string. The top ring 68 has two layers, the bottom of which, 70, is metal and the top of which, 72, is an elastomeric material such as rubber. The liner 62 is slidably engaged in the counterbore 48", and the top ring forms a resiliently yieldable abutment for it in the event that it engages the bottom of the bore 48". In normal operation, the liner stops just short of the top ring, but in the event that it does not do so, the ring prevents the bottom of the liner from being swaged over by the harder metal of the drive head.

Normally, an elastomeric wear ring 74 is also provided in the groove 50 of the drive head at the bottom of the neck 56.

Figure 4:
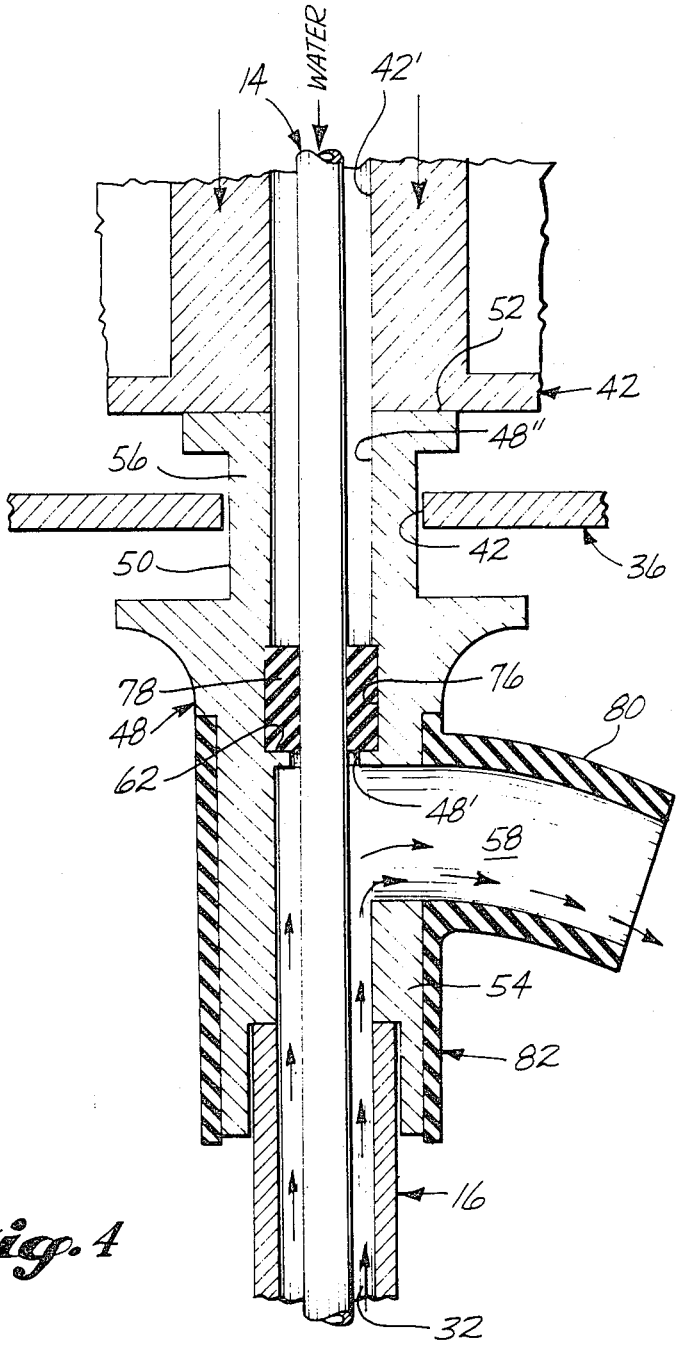
FIG. 4 is a part cross sectional elevational view of a modified version of the drive head in the mechanism.

In FIG. 4, a shallow circumferential groove 76 is formed on the wall of the counterbore 48' at the bottom thereof to receive an elastomeric gland 78. The gland is carried on and adapted to be forcibly engaged in the groove by the drill string when the latter is inserted in the bore 48' of the head. In this manner, the liner 62 may be omitted inasmuch as the gland effectively seals the case 36 against the introduction of debris from the bore of the drive head.

In FIG. 4, moreover, the nipple 80 of the port 58 in the drive head is formed by an elastomeric sleeve 82 rabbeted onto the outside portion 54 of the same.

The well casing 16 may comprise unflanged pipe, and in such a case, the relatively outside portion 54 of the drive head may be adapted to accommodate two or more sizes of the pipe. For example, in the embodiment of FIGS. 1–3, the bottom of the head is counterbored to form a socket 84 for a smaller size of pipe about which the head will telescope. However, the head also has an outer peripheral rabbet 86 on the bottom thereof, forming a shoulder 88 which is engageable with a larger size of pipe when the head is telescoped into the bore of the same.

Ordinarily, the weight of the hammer mechanism 8 provides sufficient hold down force in a vertical hammering operation. However, where the operation is conducted along other than a vertical axis, or if additional hold down force is needed, a supplementary device 90 can be employed to apply a force opposed to that of the hoisting device. The supplementary device 90 comprises a pair of pneumatic cylinders 92 on the bottom of the case 36, and a pair of cables 94 which are wound about an additional pair of winches 96 on the bed of the truck. The cables 94 are attached to the piston rods 98 of the cylinders so that when actuated, the cylinders can provide a resiliently yieldable hold down force on the case as the ram is raised to be impacted against the drive head.

Figure 2:
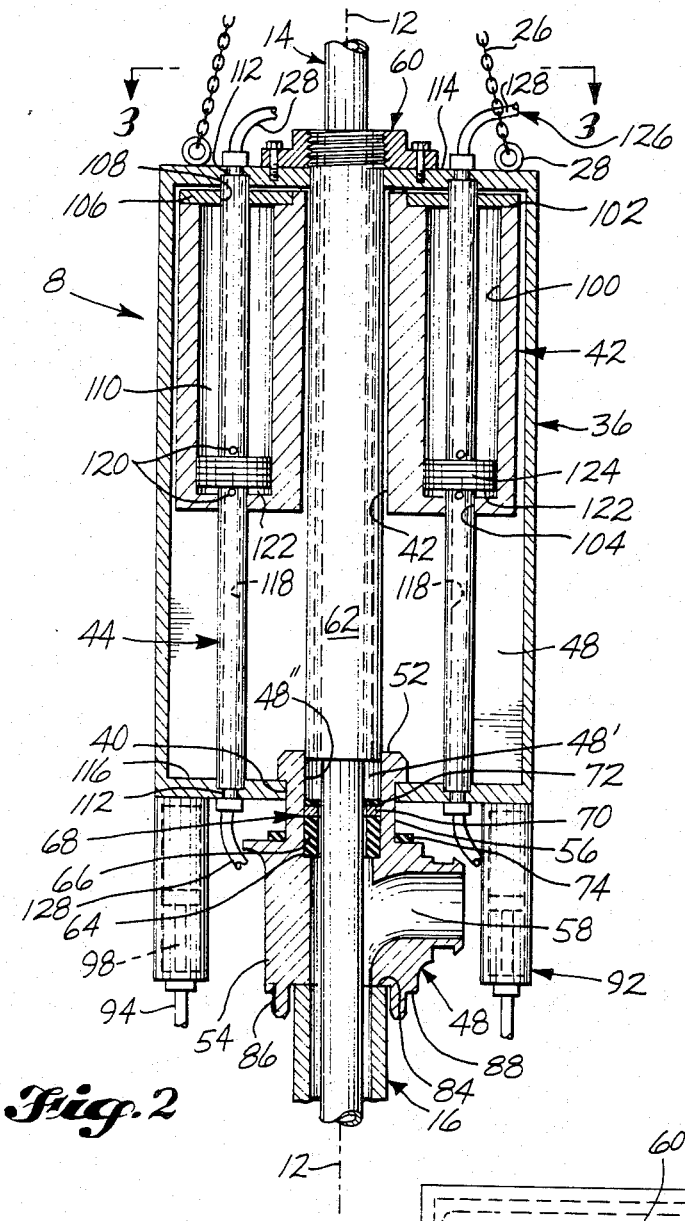
FIG. 2 is a more detailed part cross sectional elevational view of the hammer mechanism in particular.
Figure 3:
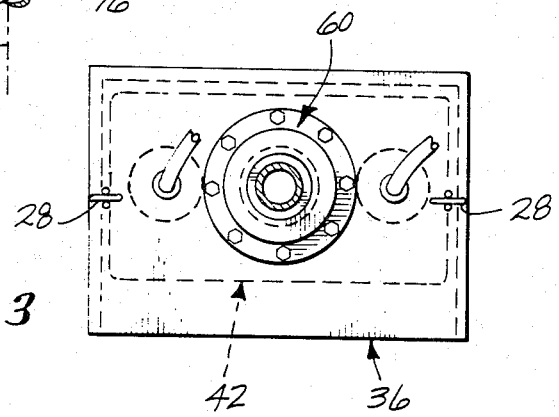
FIG. 3 is a top view of the hammer mechanism.

Referring now to the additional details of FIG. 2, it will be seen that the top of the ram 42 is end rabbeted and has a pair of deeply cylindrically recessed bores 100 in the shoulders 102 of the same which coincide with the axes of the posts 44. The bores 100 have central apertures 104 in the bottoms thereof which open into the bottom of the ram, and the apertures 104 are sized so that the ram can be slidably engaged on the posts as shown. In addition, similarly apertured plates 106 are secured to the ram in the rabbets 102 to cover the bores 100 while slidably engaging on the posts at the apertures 108 thereof. Together, the plates 106 and bores 100 define a pair of vertically elongated cylindrical chambers 110 which are operatively enclosed within the ram and have the posts 44 passing upright therethrough.

The posts 44 themselves are countersunk into interiorly rabbeted apertures 112 in the top 114 and bottom 116 of the case, and have axially extending fluid passages 118 in the top and bottom portions thereof. The passages 118 open into the chambers 110 through pairs of symmetrically spaced ports 120 in the bodies of the posts. Flanged about the posts in the spaces between the pairs of ports 120 is a pair of piston-like collars 122 which are equipped with sealing rings 124 at the circumferences thereof and have the ram slidably guided thereon at the cylindrical side walls of the chambers 110. The collars 122 thus bifurcate the respective chambers 110 into relatively upper and lower portions; and means 126 including pairs of air hoses 128 are nippled to the passages 118 in the posts at the apertures 112 of the case to enable compressed air to be injected alternately into the upper or the lower portions of the respective chambers to drive the ram counterdirectionally to the alternate sides of the collars by reacting therewith, while the air in the opposing portions is vented through the other set of hoses to a relatively low pressure zone such as ambient atmosphere.

Figure 5:
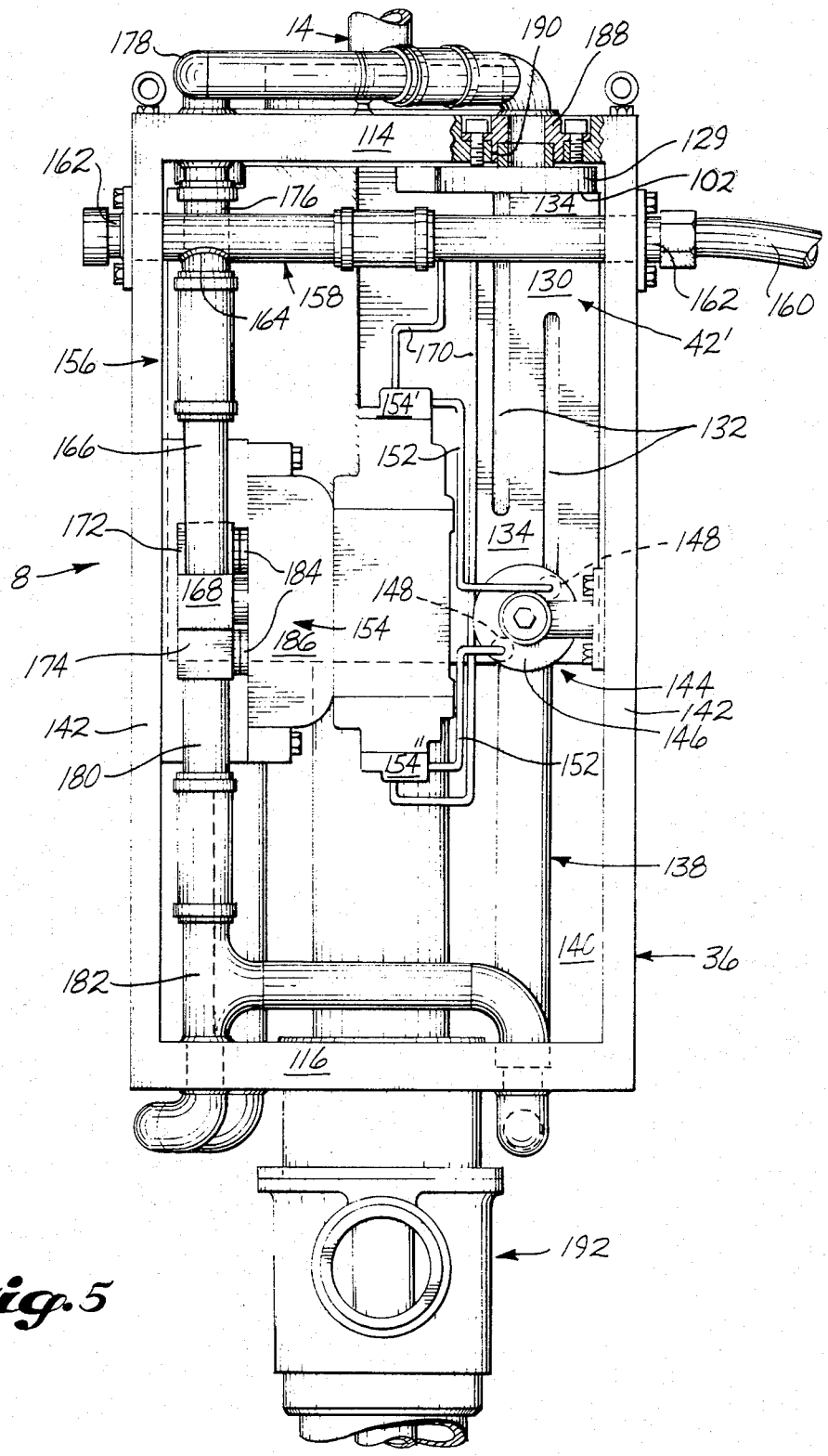
FIG. 5 is an elevational view of a fully automated version of the hammer mechanism.
Figure 6:
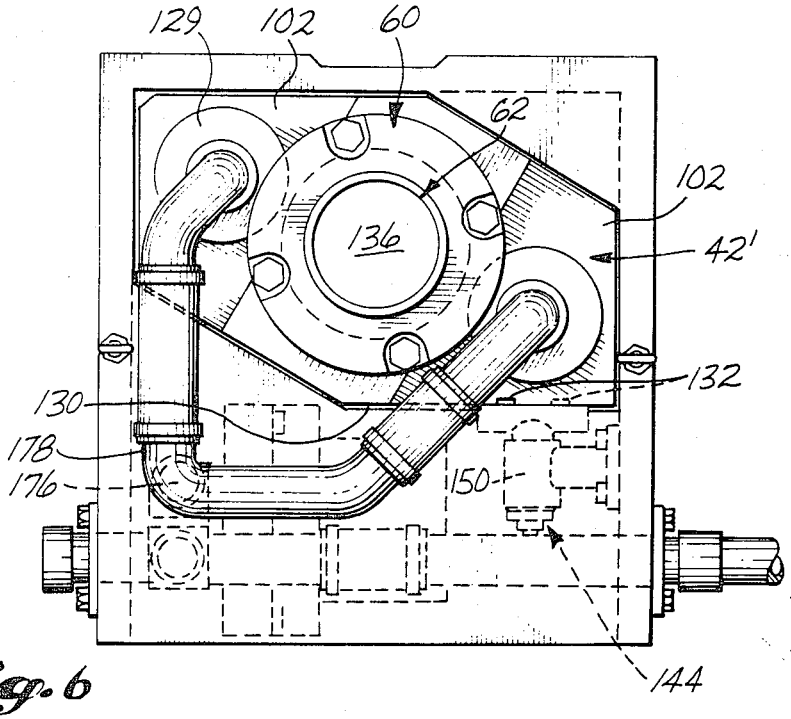
FIG. 6 is a top view of the fully automated version.
Figure 7:
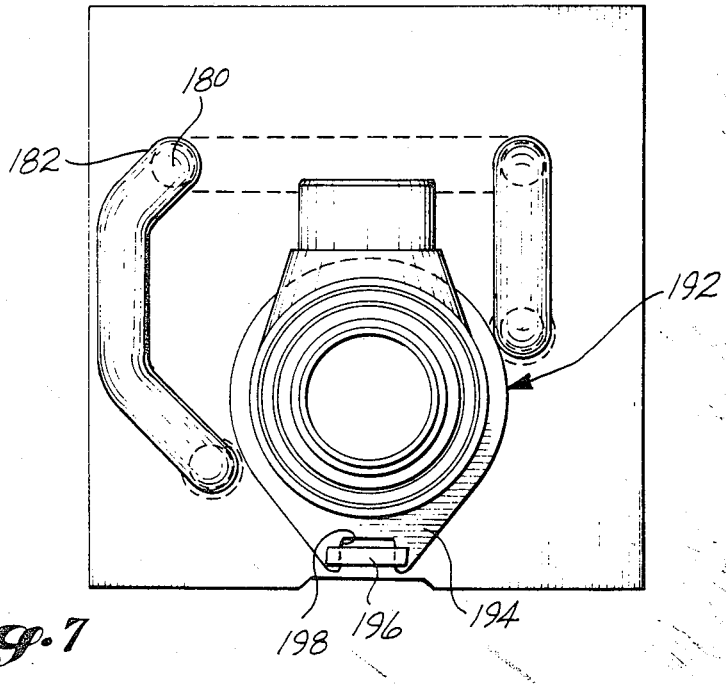
FIG. 7 is a bottom view of the same.

FIGS. 5–7 further illustrate the air injection means 126 when the hammer mechanism 8 is adapted to be operated in fully automatic fashion. In this instance, the ram 42' is trapezoidally cross sectioned to balance the mechanism about the plane of the crotch line, and has a pair of diagonally recessed shoulders 128 in the top thereof to accommodate a pair of discs 129 acting to cover the chamber-forming bores thereof (not shown) in the manner of the plates 106 in FIGS. 1–4. Also, that face 130 of the ram which is laterally oriented toward the viewer in FIG. 5, has a pair of spaced parallel vertical grooves 132 therein which are mutually offset longitudinally the reciprocable path of the ram to form collateral mutually longitudinally offset lands 134 on the face of the ram. The grooves 132 also open into the adjacent shoulder 102 and the bottom of the ram, respectively, at the opposing ends thereof. Otherwise, the ram is similar in character to that shown in FIGS. 1–4 in that it has a central bore 136 (FIG. 6) therethrough and is slidably impaled on a pair of strut-like posts 138 in the hollow 140 of the case 36.

In addition to the top 114 and bottom 116 thereof, the case 36 has interconnecting side walls 142; and ensconced on the right hand side wall in FIG. 5 is a bleed valve 144 which makes sliding contact with the aforementioned face 130 of the ram. The valve 144 comprises a disc shaped facer member 146 which has a pair of ports 148 therein and is carried on the inside end of a housing 150 to be yieldably biased into sliding contact with the face 130 of the ram by spring loading means (not shown) therein. The ports 148 are disposed in the member to register with the respective grooves 132 as they travel opposite the same, or with the lands 134 corresponding to the respective grooves when the grooves are out of registry with the ports. The ports 148 are fed by a pair of feeder tubes 152 emanating from elsewhere in the case, as shall be explained.

Ensconced on the opposing side wall 142 of the case is a four-way shuttle-controlled reference valve 154. The valve is incorporated into an air supply system 156 which is adapted to supply pressurized air to the respective passages 118 of the posts 138, as well as to exhaust the air vented from the same, toward the end not only of driving the ram through its reciprocable path, but also of accelerating it in the respective directions of the path. The air supply system 156 comprises a main supply line 158 which is supported near the top of the side walls of the case and nippled through the same so that a supply hose 160 can be coupled to either nipple 162 while the opposing nipple is capped to close the same. Inside the case, the supply line has a tee connection 164 therein, from which an extension 166 of the same depends to an inlet 168 in the reference valve 154. The supply line also has a pair of tubes 170 connected to the same upstream from the tee connection, and the tubes are interconnected with the opposing upper and lower ends 154' and 154'' of the reference valve for purposes of pressurizing the respective ends, as shall be explained. In addition the earlier mentioned tubes 152 also connect with these ends, and the reference valve itself has a pair of feeder ports 172 and 174 therein, one of which, 172, is connected with the upper passages 118 of the posts through a feeder line 176 that bifurcates to the respective passages at 178. See FIGS. 5 and 6. The other feeder port 174 connects with the lower passages 118 of the posts through another feeder line 180 that bifurcates at 182. See FIGS. 5 and 7. The reference valve 154 also has a pair of exhaust ports 184 in the housing 186 thereof, which discharge to the ambient atmosphere for purposes of venting the respective feeder lines 176 and 180 in the exhaust phase of the valving operation.

The reference valve 154 is conventional and suffice it to say that interiorly, the shuttle (not shown) of the same is balanced between the fluid pressure signals generated in the ends 154' and 154'' of the same by the tubes 170 emenating from the main supply line 158. However, as noted earlier, the ends 154' and 154'' of the valve are also open to the tubes 152 connected with the ports 148 of the bleeder valve 144. Therefore, the respective signals are under the control of the action occuring at the bleeder valve, that is, the effect generated by the alternate interfacing of each port 148 which its respective groove 132 and land 134. The shutter is, of course, reciprocable, i.e., shiftably mounted in the housing 186 of the valve, and undergoes a shift when a differential arises between the respective signals, the direction of the shift being dependant on the direction of the differential. Therefore, as each port 148 interfaces with the corresponding groove 132, air is bled from the corresponding signal into the relatively low pressure zone constituted by the groove. At the same time, the other port 148 is opposed by the land 134 corresponding to its groove, and as a result a differential is generated between the signals. The resulting shift of the shuttle shunts the air supply in the valve to the upper or lower passages 118 of the posts, depending on the direction of the shift, and at the same time the shuttle opens the opposing passages to one of the exhaust ports 184 through the respective feeder line 176 or 180. Overall, the arrangement is such that when the ram undergoes initial reciprocation in the direction of one of the portions of the chamber, the shuttle admits pressurized air to the other portion to accelerate the ram; but when the ram undergoes continued reciprocation thereafter in the direction of the one portion of the chamber, the shuttle terminates the supply of air to the other portion and admits the air to the one portion to reverse the direction of reciprocation of the ram.

It will be seen, moreover, that the grooves 132 overlap one another longitudinally the reciprocable path of the ram, so that the direction of the pressure differential on the shuttle is gradually reversed.

The respective feeder lines 176 and 180 are interconnected with the posts 138 through grommet-like coupling elements 188 which are seated into counterbored apertures 190 in the top 114 and bottom 116 of the case and telescoped about the respective ends of the posts. See the upper right hand corner of FIG. 5.

The drive head 192 in FIGS. 5–7 in similar to that in FIGS. 1–4, but has a slotted ear 194 (FIG. 7) projecting to one side thereof, to which a T-bar hanger 196 on the case is engaged in the slot 198 thereof as a safety measure to assure that the head is retained on the case when the head is detached and lifted away from the well casing.

Figure 8:
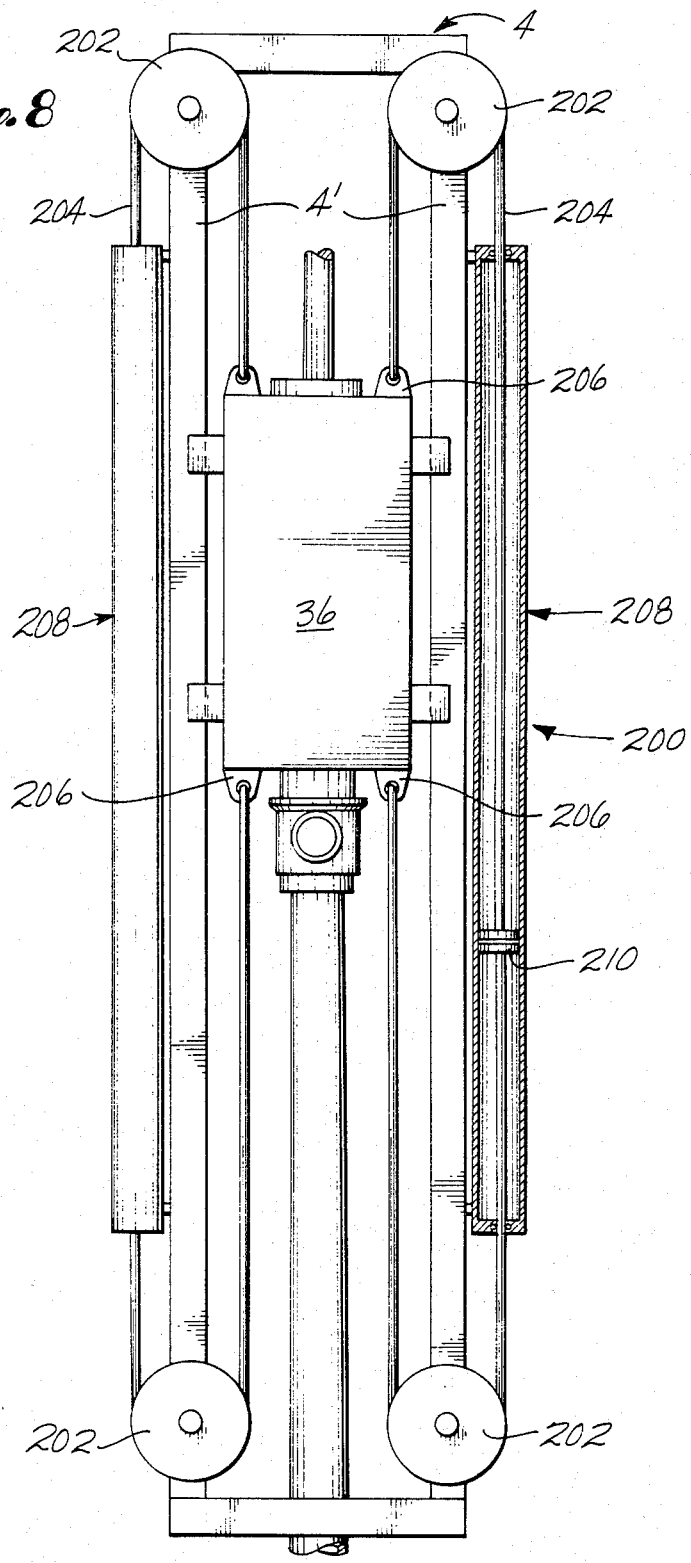
FIG. 8 is a largely schematic illustration of a modified device for positioning and advancing or retracting the hammer mechanism at any desired angle relative to the ground.

In lieu of the respective devices 18 and 90 in FIGS. 1–4 for suspending and applying hold down force to the hammer mechanism, a single closed loop pneumatic or hydraulically driven tensioning mechanism 200 can be employed in the manner of FIG. 8. In this instance, pairs of sheaves 202 are rotatably mounted on the standards 4' of the tower at sufficient spacing vertically thereof to allow for the full stroke of the hammer mechanism in the driving operation. Moreover, a pair of cables 204 are looped about the pairs of sheaves and interconnected to the top and bottom of the case 36 by means of ears 206 thereon. Each cable 204 has a pneumatic or hydraulic cylinder 208 incorporated into the loop thereof, and the pistons 210 of the respective cylinders are fixed on the cables so that the application of fluid to one side or the other of the respective pistons operates to raise or lower the hammer mechanism accordingly. In this way, the drive forces are resiliently yieldable, and an additional hold down force can by applied to the mechanism when needed, by increasing the fluid pressure on the undersides of the pistons during the hammering operation.

Figure 9:
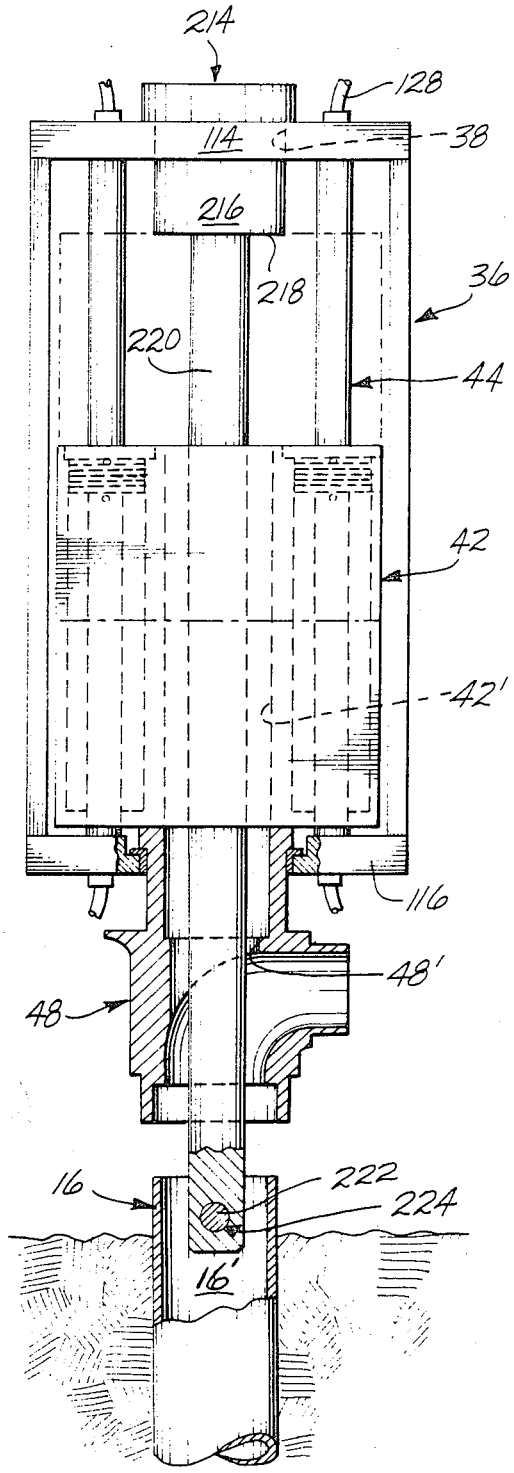
FIG. 9 is a part cross sectional elevational view of the hammer mechanism after it has been modified to be used in pulling the casing from the ground, rather than driving it into the same.

FIG. 9 illustrates a means and technique for pulling the casing 16 from the ground after the drill string 14 has been removed from the same. Referring firstly, however, to FIG. 1, it will be noted that the opening 38 in the top 114 of the case is larger than the liner 62 to accommodate a plug-like inner projection 212 on the boss 60. According to this further feature of the invention, the boss is removed from the case, together with the liner 62, and a new boss 214 is slidably inserted for the same, the projection 216 of which forms an anvil 218 on the bottom end thereof. The new boss is solid and has a bottom apertured pulling bar 220 depending from the same which is of such length to pass downwardly through the bores 42' and 48' of the ram and the head, and to reach into the bore 16' of the casing below the head. The projection 216 has a depth adapted so that the ram will impact the same in the normal course of its reciprocation, and therefore, when the bar 220 is secured to the casing, the boss 214 can serve as a means for driving the same upwardly out of the ground. There are various techniques known in the art for securing the bar 220 to the casing. One of these is illustrated in FIG. 9. According to it, a pair of diametrically opposed holes (not numbered per se) are formed in the casing to receive a dowel pin 222 which is inserted through the same, as well as through the aperture 224 in the bottom portion of the bar, to interconnect the casing to the bar and vice-a-versa.

What is claimed is:

1. In drilling apparatus wherein means are connectible with an elongated tubular piece to form a tubular anvil on one end thereof for the transmission of impact forces to the piece, a drill string is inserted through the anvil into the one end of the piece, and the piece is driven into the ground or the like by impacting the anvil while the drill string is operated in the piece, the improvement comprising a support, a tubular anvil-impacting ram reciprocably mounted on the support and having a pair of spaced parallel grooves in one face thereof which are mutually offset longitudinally the reciprocable path of the ram to form collateral mutually longitudinally offset lands on the one face thereof, and means for reciprocating the ram including valve means having fluid connections with points in the paths of the respective grooves in the one face of the ram and the lands corresponding thereto.

2. The apparatus according to claim 1 wherein the valve means include a shuttle valve, the shuttle of which is under the control of a pair of pressurized air charges which are subject to being discharged through a pair of ports that open into the one face of the ram at the aforesaid points in the reciprocable path thereof.

3. The apparatus according to claim 2 wherein the ports are defined by a valve head which is yieldably biased to interface with the one face of the ram at a fixed location thereopposite.

4. The apparatus according to claim 1 wherein the ram has a plurality of hollow chambers operatively symmetrically enclosed therewithin about the hollow bore thereof, the support has means thereon defining an elongated guide in each chamber and a septum which is relatively fixed in the chamber on the guide transverse the reciprocable axis of the ram to form a piston separating the relatively axially opposing end portions of the chamber, the valve means are operable to admit pressurized air to corresponding portions of the chamber while used air is exhausted to atmosphere from the opposing portions thereof and vice versa, and the respective grooves and lands are operable to cause the valve means to reverse the fluid flow to and from the respective corresponding and opposing portions of the chamber when the ram has undergone a predetermined length of travel in each reciprocable direction thereof.

5. In a drilling apparatus wherein means are connectible with an elongated tubular piece to form a tubular anvil at one end thereof for the transmission of impact forces to the piece, a drill string is inserted through the anvil into the one end of the piece, and the piece is driven into the ground or the like by impacting the anvil while the drill string is operated in the piece, the improvement comprising a support, an anvil-impacting ram movably guided on the support to reciprocate along an axis parallel to the longitudinal axis of the piece, said ram having an axial bore therethrough to enable the drill string to be inserted therethrough and a plurality of hollow chambers operatively symmetrically enclosed therewithin about the bore, said support having means thereon defining elongated guides in the respective chambers and septa thereon which are relatively fixed in the chambers transverse the reciprocable axis of the ram to form pistons separating the relatively axially opposing end portions of the chambers, said axially opposing end portions of the chambers having a common cross-sectional area about the guides transverse the reciprocable axis of the ram, and means for driving the ram with equal force in the alternate reciprocable directions thereof, including a source of gaseous fluid under pressure, valve means interconnecting the gaseous fluid source with the respective end portions of the chambers through the opposing end portions of the guides to admit the pressurized fluid to corresponding portions of the chambers independently of one another and independently of the opposing portions thereof and vice versa, means defining an outlet for discharging the used fluid to atmosphere, control means on the ram and the suppport which are cooperatively engagable with one another adjacent the reciprocable path of the ram and responsive to reciprocation of the ram to cause the valve means to admit the fluid to corresponding portions of the chambers while the use fluid is exhausted to the outlet from the opposing portions of the chambers and vice versa, and means connected with the valve means to reverse the fluid flow to and from the respective corresponding and opposing portions of the chambers when the ram has undergone a predetermined length of travel in each reciprocable direction thereof, said valve means including a reciprocable valve member and means for applying a pair of mutually opposing fluid pressure signals to the valve member to balance the same against reciprocation, and said control means including a pair of spaced parallel grooves in one face of the ram which are mutually offset longitudinally the reciprocable axis of the ram to form collateral mutually longitudinally offset lands on the one face of the ram, and fluid connections between the respective fluid pressure signals on the valve member and points in the paths of the respective grooves in the one face of the ram and the lands corresponding thereto, whereby the respective fluid pressure signals are alternately discharged to a relatively low pressure zone in the respective grooves while the opposing signals are closed to the same by the lands, to generate a differential between the signals to unbalance the valve member in the sense of admitting the fluid to one portion of each chamber while the used fluid is exhausted to the outlet from the other portion thereof, and vice versa.

6. The apparatus according to claim 5 wherein the grooves overlap one another longitudinally the reciprocable axis of the ram, so as to gradually reverse the direction of the pressure differential on the valve member.

7. In a drilling apparatus wherein means are connectible with an elongated tubular piece to form a tubular anvil at one end thereof for the transmission of impact forces to the piece, a drill string is inserted through the anvil into the one end of the piece, and the piece is driven into the ground or the like by impacting the anvil while the drill string is operated in the piece, the improvement comprising a support, an anvil-impacting ram movably guided on the support to reciprocate along an axis parallel to the longitudinally axis of the piece, said ram having an axial bore therethrough to enable the drill string to be inserted therethrough and a plurality of hollow chambers operatively symmetrically enclosed therewithin about the bore, said support having means thereon defining elongated guides in the respective chambers and septa thereon which are relatively fixed in the chambers transverse the reciprocable axis of the ram to form pistons separating the relatively axially opposing end portions of the chambers, said axially opposing end portions of the chambers having a common cross-sectional area about the guides transverse the reciprocable axis of the ram, and means for driving the ram with equal force in the alternate reciprocable directions thereof, including a source of gaseous fluid under pressure, valve means interconnecting the gaseous fluid source with the respective end portions of the chambers through the opposing end portions of the guides to admit the pressurized fluid to corresponding portions of the chambers independently of one another and independently of the opposing portions thereof and vice versa, means defining an outlet for discharging the used fluid to atmosphere, control means on the ram and the support which are cooperatively engagable with one another adjacent the reciprocable path of the ram and responsive to reciprocation of the ram to cause the valve means to admit the fluid to corresponding portions of the chambers while the used fluid is exhausted to the outlet from the opposing portions of the chambers and vice versa, and means connected with the valve means to reverse the fluid flow to and from the respective corresponding and opposing portions of the chambers when the ram has undergone a predetermined length of travel in each reciprocable direction thereof, the control means including a pair of spaced parallel grooves in one face of the ram which are mutually offset longitudinally the reciprocable axis of the ram to form collateral mutually longitudinally offset lands on the one face of the ram, and sensory means operatively opposed to the grooves and lands to interface with points in the paths of the same on reciprocation of the ram to cause the valve means to admit the fluid to one portion of each chamber while the used fluid is exhausted to the outlet from the other portion thereof, and vice versa.

8. In apparatus wherein means connectible with an elongated piece to form an anvil on one end thereof for the transmission of impact forces to the piece, and the piece is driven into the ground or the like by impacting the anvil, the improvement comprising support means, an anvil impacting ram movably guided on the support means to reciprocate along an axis parallel to the longitudinal axis of the piece, said ram having a plurality of hollow chambers operatively symmetrically enclosed therewithin and said support means having means thereon defining elongated guides in the respective chambers and septa thereon which are relatively fixed in the chambers transverse the reciprocable axis of the ram to form pistons which separate the relatively axially opposing sets of end portions of the chambers from one another, and drive means for reciprocating the ram through the stroke thereof, including means defining a source of pressurized gas and an outlet for exhausting used gas to atmosphere, valve means operable to interconnect the pressurized gas source and the outlet with alternate but opposing sets of chamber portions, and means responsive to reciprocation of the ram to operate the valve means including means defining a pair of elongated control surfaces extending parallel to the reciprocable axis of the ram on one laterally oriented face of the ram, and having first portions thereof spaced apart from one another along lines extending parallel to the reciprocable axis of the ram, to correspond to the end portions of the stroke of the ram, said surfaces being mutually offset from one another longitudinally of the axis so that they have second portions thereof which overlap one another longitudinally of the axis from line to line, sensor means disposed adjacent the one face of the ram on the support means to register with the control surfaces during the stroke of the ram, and actuator means operable to cause the valve means to admit the pressurized gas to one set of chamber portions while discharging used gas to the outlet from the other set of chamber portions when the sensory means are in registry with the respective first portions of the control surfaces and the second portions thereof are moving relatively toward the sensory means, and to cause the valve means to reverse the gas flow to and from the respective sets of chamber portions when the sensory means are in registry with the respective first portions of the control surfaces and the second portions thereof are moving relatively away from the sensory means.

9. The apparatus according to claim 8 wherein the control surfaces are also operative to prepare the valve means for reversal of the gas flow to and from the respective sets of chamber portions when the sensory means are in registry with the second portions of the control surfaces, so that the change in direction of flow is gradual.

10. The apparatus according to claim 9 wherein the valve means, the sensory means, and the actuator means are interconnected by the control surfaces in a normally balanced two-directional circuit, and the control surfaces are operable to unbalance the circuit in one direction thereof when the sensory means are in registry with the first portions of the surfaces at the ends of the lines corresponding to said one direction and the second portions are moving away from the sensory means, then re-balance the circuit when the sensory means are in registry with the second portions of the surfaces, and then unbalance the circuit in the other direction thereof when the sensory means are in registry with the first portions of the surfaces at the ends of the lines corresponding to said other direction and the second portions are moving away from the sensory means.

11. The apparatus according to claim 10 wherein the circuit is a fluid pressure circuit and the valve means include a valve member which is reciprocably mounted to reciprocate in one direction thereof when the circuit is unbalanced in the aforesaid one direction thereof and to reciprocate in the other direction thereof when the circuit is unbalanced in the aforesaid other direction thereof.

12. The apparatus according to claim 11 wherein the sensory means take the form of a pair of fluid outlets in the pressurized fluid circuit which are connected with the opposing ends of the valve member and slidably engagable with the one face of the ram to register with the control surfaces thereon, and wherein the control surfaces take the form of a pair of grooves in the one face of the ram which are mutually offset longitudinally the reciprocable axis of the ram on spaced parallel lines to form collateral mutually longitudinally offset lands on the lines, and which are adapted, respectively, to discharge fluid from one of the outlets while the corresponding land covers the other outlet, and vice versa, to generate opposing fluid pressure differentials in the circuit across the valve member during the to and fro motion of the ram in the end portions of its stroke, the grooves overlapping with one another along the lines thereof so that the respective fluid pressure differentials across the valve member undergo gradual change from one differential to the other.

13. The apparatus according to claim 8 wherein the sets of chamber portions have a common cross-sectional area about the guides transverse the reciprocable axis of the ram, and the valve means interconnect the pressurized gas source and the outlet with the respective sets of chamber portions to admit and discharge gas to and from the respective chamber portions in each set independently of one another and independently of the chamber portions in the other set.

14. The apparatus according to claim 8 wherein the ram has an axial bore therethrough.

15. The apparatus according to claim 14 further comprising means insertable in the axial bore of the ram to adapt the apparatus so that the ram can be employed to drive the piece out of the ground or the like.

16. The apparatus according to claim 15 wherein the support means have an anvil-forming drive head thereon and the bore-insertable adaption means includes means for forming an additional anvil on the support means, on the opposite side of the ram from the drive head.

17. The apparatus according to claim 16 wherein the drive head is tubular and the additional anvil-forming means have a projection thereon insertable through the ram and the drive head for attachment to the piece.

18. The apparatus according to claim 14 wherein the support means have an anvil-forming drive head thereon which is tubular to enable a drill string to be inserted into the piece through the bore of the ram.

19. The apparatus according to claim 18 wherein the body of the drive head is adapted to form a passage for liquid to flow therethrough.

20. The apparatus according to claim 8 wherein the guides take the form of posts relatively upstanding on the support means, the ram is slidably guided on the posts so that the chambers are operatively enclosed therewithin about the posts, and there are collars on the respective posts defining the septa.

21. The apparatus according to claim 20 wherein the pressurized gas source and the outlet are connected to the sets of chamber portions through the relatively remote ends of the posts.

22. The apparatus according to claim 8 wherein the valve means include a reciprocable valve member and means for applying a pair of mutually opposing signals to the valve member to balance the same against reciprocation, and wherein the actuator means are operable to generate a differential between the signals to unbalance the valve member in the sense of admitting the gas to one set of chamber portions while the used gas is discharged to the outlet from the other set of chamber portions, and vice versa.

23. The apparatus according to claim 8 wherein the guides have gas flow passages therein which communicate with the valve means through the axially opposing ends thereof.

24. The apparatus according to claim 8 further comprising means for positioning the support means in relation to the piece, and means for restraining the support means against reciprocation from the position thereof when the ram is retracted from the piece for delivery of the next blow to the same.

25. The apparatus according to claim 8 wherein the piece is tubular, the anvil forming means form a tubular anvil on the one end of the piece, a drill string is inserted through the anvil into the one end of the piece, and the piece is driven into the ground or the like by impacting the anvil while the drill string is operated in the piece, and wherein the ram has an axial bore therethrough to enable the drill string to be inserted therethrough, and the chambers are operatively symmetrically enclosed within the ram about the bore thereof.

26. In apparatus wherein means are connectible with an elongated piece to form an anvil on one end thereof for the transmission of impact forces to the piece, and the piece is driven into the ground or the like by impacting the anvil, the improvement comprising a support, an anvil impacting ram reciprocably mounted on the support and having a pair of spaced parallel grooves in one face thereof which are mutually offset longitudinally the reciprocable path of the ram to form collateral mutually longitudinally offset lands on the one face thereof, and means for reciprocating the ram including valve means having fluid connections with points in the paths of the respective grooves in the one face of the ram and the lands corresponding thereto.

27. A ram for use in apparatus wherein means are connectible with an elongated piece to form an anvil on one end thereof and the piece is driven into the ground or the like by impacting the anvil with a reciprocable ram driven by a drive mechanism that is operated by a valve which is reciprocably mounted in a normally balanced two directional fluid pressure circuit to reciprocate in the alternate directions thereof when the circuit is unbalanced in the respective directions thereof, said circuit having a pair of fluid outlets therein which are connected with the opposing ends of the valve and disposed to slidably engage with the ram during the stroke thereof, comprising an anvil impacting body having a striking surface on one end thereof and a pair of grooves in one laterally oriented face thereof which are mutually offset longitudinally the reciprocable axis of the body on spaced parallel lines to form collateral mutually longitudinally offset lands on the lines, and which are adapted in axial extent, respectively, to discharge fluid from one of the outlets while the corresponding land covers the other outlet, and vice versa, to generate opposing fluid pressure differentials in the circuit across the valve and thereby unbalance the circuit in the respective directions thereof, when the body is reciprocably supported and guided in the apparatus and driven by the mechanism so that the lines of the grooves and lands intersect the outlets.

28. The ram according to claim 27 wherein the groove overlap one another along the lines thereof so that the respective fluid pressure differentials across the valve undergo gradual change from one differential to the other.

29. The ram according to claim 27 wherein the body has an axial bore therethrough so that it can be used to impact a tubular anvil while a drill string is inserted through the bores of the ram and the anvil into one end of an elongated tubular piece having the anvil connected therewith.

30. The ram according to claim 27 wherein the body has means thereon whereby a plurality of hollow chambers can be operatively symmetrically enclosed within the body about the bore thereof to provide reaction surfaces for the drive mechanism of the apparatus.

* * * * *

UNITED STATES PATENT AND TRADEMARK OFFICE

CERTIFICATE OF CORRECTION

PATENT NO. : 4,544,040

DATED : October 1, 1985

INVENTOR(S) : Gerald T. Sweeney

It is certified that error appears in the above-identified patent and that said Letters Patent are hereby corrected as shown below:

Column 1, line 54, Column 2, lines 10, 14 and 21 correct "sensor" to read --sensory--.

Column 6, line 5, correct "48'" to --48"--.

Column 8, line 26, correct "shutter" to read --shuttle--.

Column 11, line 37, change "longitudinally" to read --longitudinal--.

Column 12, line 14 thereof, after "means" insert --are--.

Column 12, line 47, correct "sensor" to --sensory--.

Signed and Sealed this

*Third* Day of *December 1985*

[SEAL]

*Attest:*

DONALD J. QUIGG

*Attesting Officer*

*Commissioner of Patents and Trademarks*